US006443208B1

(12) United States Patent
Win

(10) Patent No.: US 6,443,208 B1
(45) Date of Patent: Sep. 3, 2002

(54) WINDOW SECURING APPARATUS

(76) Inventor: Joseph T. S. Win, 126 W. Lemon Ave., Arcadia, CA (US) 91007

( * ) Notice: Subject to any disclaimer, the term of this patent is extended or adjusted under 35 U.S.C. 154(b) by 0 days.

(21) Appl. No.: 09/685,207

(22) Filed: Oct. 10, 2000

(51) Int. Cl.[7] ..... E06B 9/36
(52) U.S. Cl. ..... 160/172 V; 160/34; 160/201
(58) Field of Search ..... 160/33, 170 R, 160/34, 172 R, 172 V, 201

(56) References Cited

U.S. PATENT DOCUMENTS

| | | | | |
|---|---|---|---|---|
| 11,311 | A | * | 7/1854 | Ward |
| 227,355 | A | | 5/1880 | Guild |
| 785,690 | A | | 3/1905 | Wolfe |
| 879,342 | A | | 2/1908 | Wells |
| 1,179,328 | A | * | 4/1916 | Lancaster |
| 1,378,378 | A | | 5/1921 | Petterson |
| 1,634,843 | A | | 7/1927 | McWane |
| RE17,978 | E | | 2/1931 | McWane |
| 1,996,931 | A | | 4/1935 | McGuinnes |
| 2,205,156 | A | * | 6/1940 | Rowley |
| 2,299,095 | A | * | 10/1942 | Knox |
| 2,577,884 | A | * | 12/1951 | Garubo |
| 2,874,771 | A | * | 2/1959 | Muhr |
| 2,957,520 | A | * | 10/1960 | Howard |
| 3,520,346 | A | * | 7/1970 | Green |
| 3,578,060 | A | * | 5/1971 | Spenser |
| 3,658,112 | A | * | 4/1972 | Imaizumi |
| 4,243,090 | A | | 1/1981 | Kemp |
| 4,452,010 | A | | 6/1984 | Whittington et al. |
| 4,485,589 | A | | 12/1984 | Rodriguez-Torres |
| 5,163,494 | A | * | 11/1992 | MacNeil |
| 5,181,548 | A | | 1/1993 | Matthews |
| 5,316,065 | A | * | 5/1994 | Alligood |
| 6,021,838 | A | * | 2/2000 | Taffe |
| 6,061,962 | A | | 5/2000 | Sosa |

* cited by examiner

*Primary Examiner*—Blair M. Johnson
(74) *Attorney, Agent, or Firm*—William W. Haefliger

(57) ABSTRACT

In combination, a window frame and a series of bars carried by the frame for bodily movement toward and away from a side of the frame, said bars having ends, and locking members to lock opposite ends of the bars in window protecting positions thereof, and wherein the bars have been moved way from said side of the frame. Louvers may also be carried by the bars, for added security, and for decorative effect.

10 Claims, 7 Drawing Sheets

10
10a
26
30
28
12
35
10d
10c
31
27
10b 10a
26
30
28
10d
10
11
12
10c
31
27
10b 4
18
13
10a
15
26
13a
6
12a
6
23
30
10
19
21
22
21a
12c
44
10g
10e
50
10d
12
12
12
28
35
35
12d
10f
14a
27
20
18a
12b
14
10b
16
4

FIG. 13.
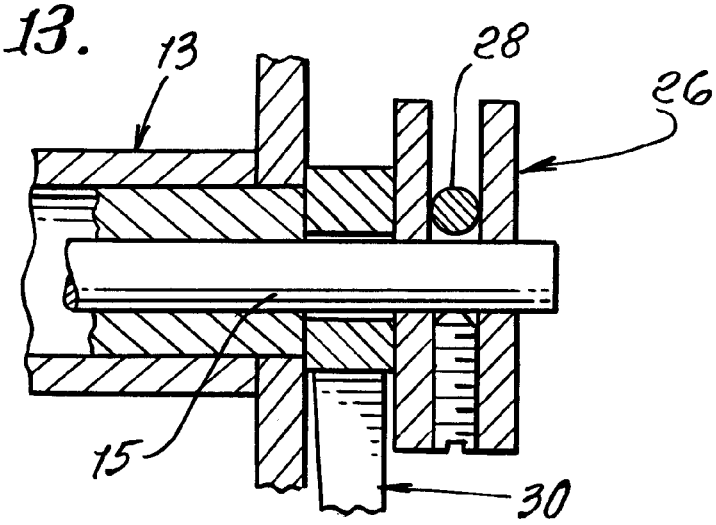
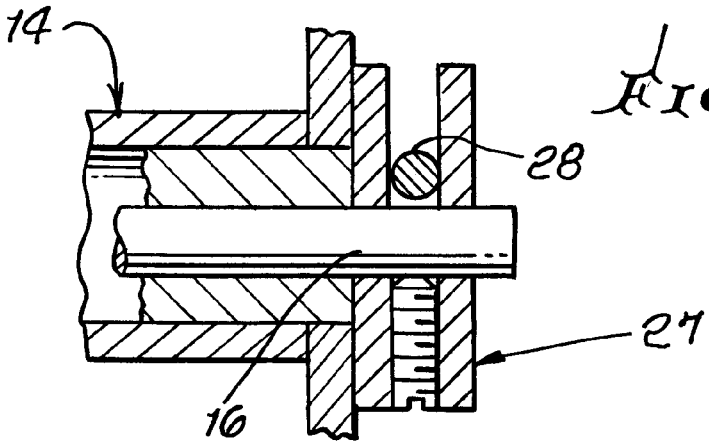
FIG. 14.
FIG. 15.
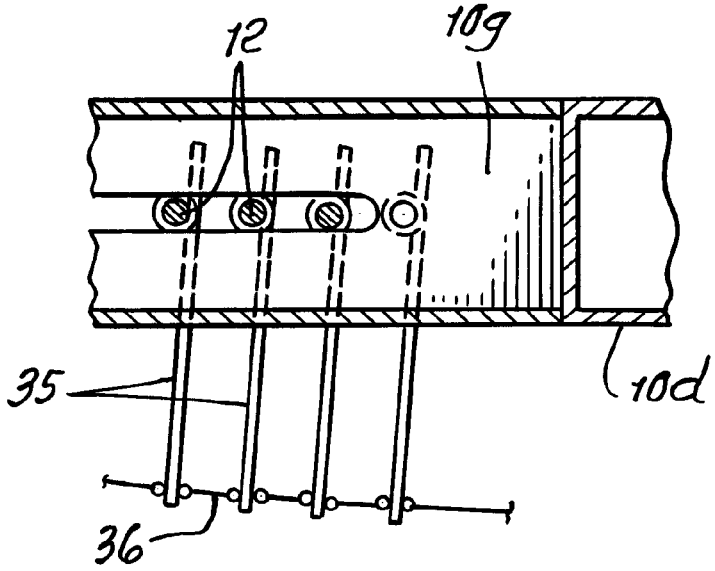

WINDOW SECURING APPARATUS

BACKGROUND OF THE INVENTION

This invention relates generally to the controlled prevention of access through windows, and more particularly to window bars that are movable into and out of position blocking access through a window, and which are easily and securely lockable in that position. The invention also provides for mounting of louvers on such movable bars. The rods and louvers provide a product offering both security and decorative effect.

There is continuing need for prevention of access through windows, as by use of bars; however, efficient control of movement of such bars into and out of access blocking relation is also desirable, in order not to prevent escape from a room interior through the window, as in the case of fire or smoke in the room.

There is also need for a way to securely lock window bars in such access blocking position, and to unlock the bars, as by enabling their movement to enable such access.

SUMMARY OF THE INVENTION

It is a major object of the invention to provide improvements in apparatus and method to meet the above needs. Basically, the apparatus of the invention comprises:

a) a window frame and a series of bars carried by the frame for bodily movement toward and away from a side of the frame, the bars having ends, and b) locking members to lock opposite ends of the bars in window protecting position wherein the bars have been moved away from a side of the frame.

As will appear, louvers may be carried by the movable bars, in such manner as not to interfere with their controlled movement away from access blocking position, and also to add decorative effect to the bars, which provide security.

Another object is to provide first hinged members connected with certain ends of the bars that extend in a first row and second hinged members connected with other ends of the bars that extend in a second row.

A further object is to provide a frame to have first and second sections that extend generally parallel, the first hinged members located proximate the frame first section, and the second hinged members located proximate the frame second section.

An added object is to provide locking members that include first locking members movable into and out of rod end captivating position, and second locking members movable into and out of rod end captivating position, the first and second locking members being respectively at opposite ends of the rods.

As will appear, structure may be provided to operatively interconnect the first and second locking members, to move in synchronism, whereby opposite ends of the bars may be simultaneously locked in window access blocking position, and may be simultaneously unlocked, to allow bar movement out of such position. Further, the first and second locking members may comprise tubes having main slits extending lengthwise of the tubes and into which the rod ends are received for travel during said bodily movement of the rods, the tubes also having branch slits into which the rod ends are received and captivated, in response to tube rotation, to captivate the rods.

These and other objects and advantages of the invention, as well as the details of an illustrative embodiment, will be more fully understood from the following specification and drawings, in which:

DRAWING DESCRIPTION

FIG. 13 is a section taken on lines 13—13 of FIG. 11;

FIG. 14 is a section taken on lines 14—14 of FIG. 4;

FIG. 15 is a section taken on lines 15—15 of FIG. 8, and

DETAILED DESCRIPTION

Figure 2:
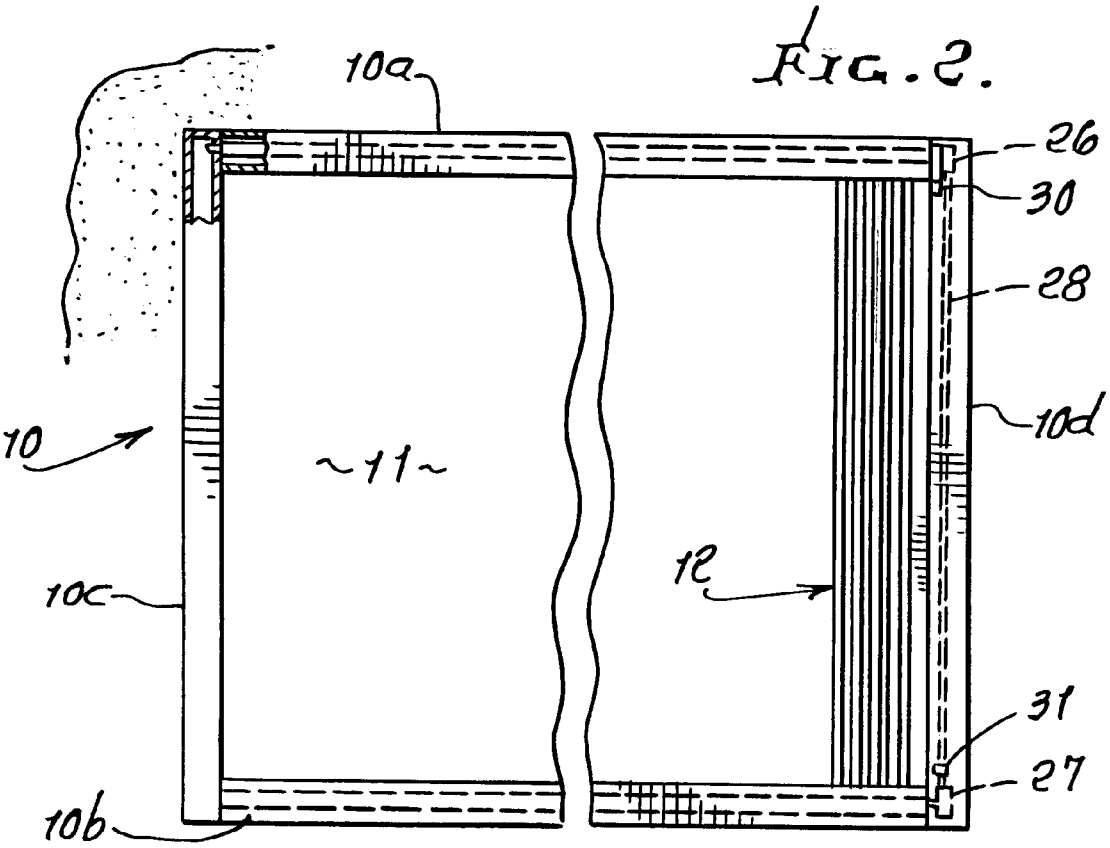
FIG. 2 is a view like FIG. 1 but showing, the bars in retracted positions allowing access through the window.

In the drawings, a window frame 10 has upper and lower horizontal sections 10*a* and 10*b,* and left and right vertical sections 10*c* and 10*d.* The rectangular window space to be protected against through access is indicated at 11, as in FIG. 2.

Figure 1:
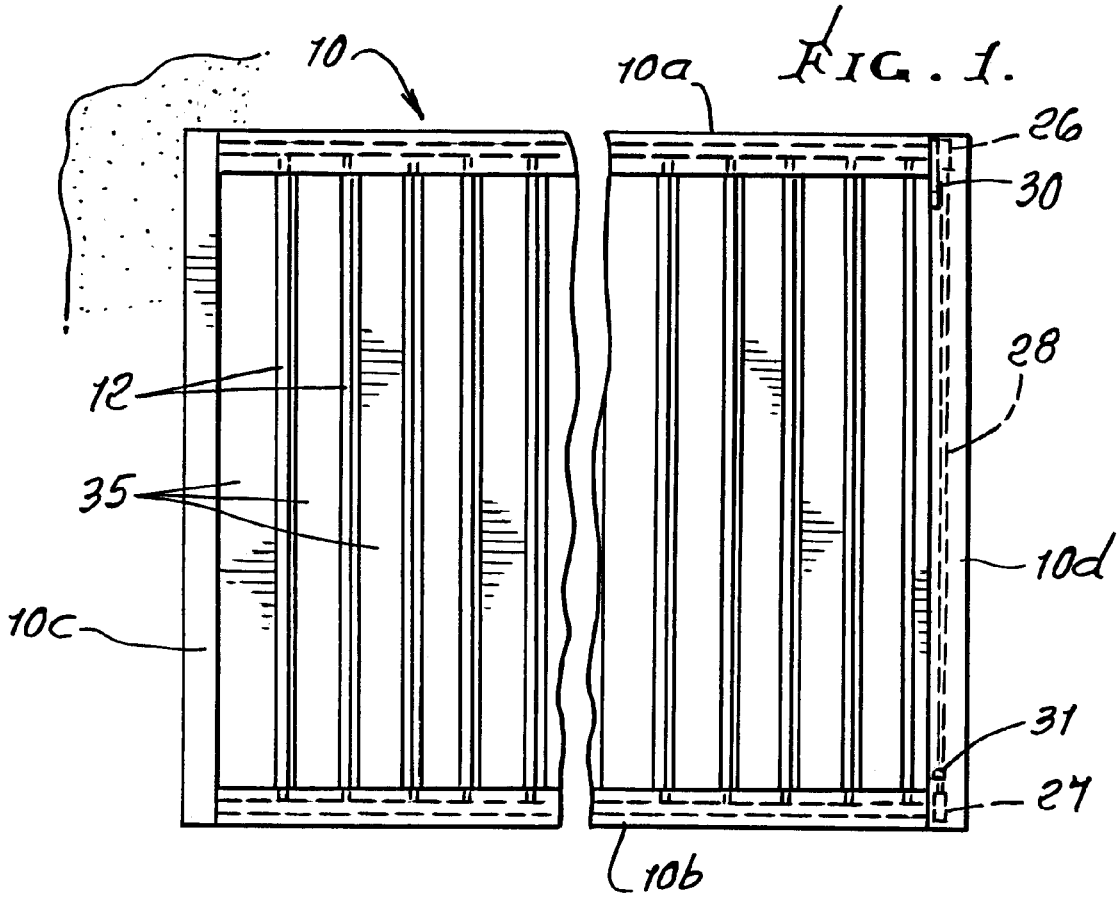
FIG. 1 is a frontal view of window apparatus incorporating the invention showing security bars in extended positions.
Figure 3:
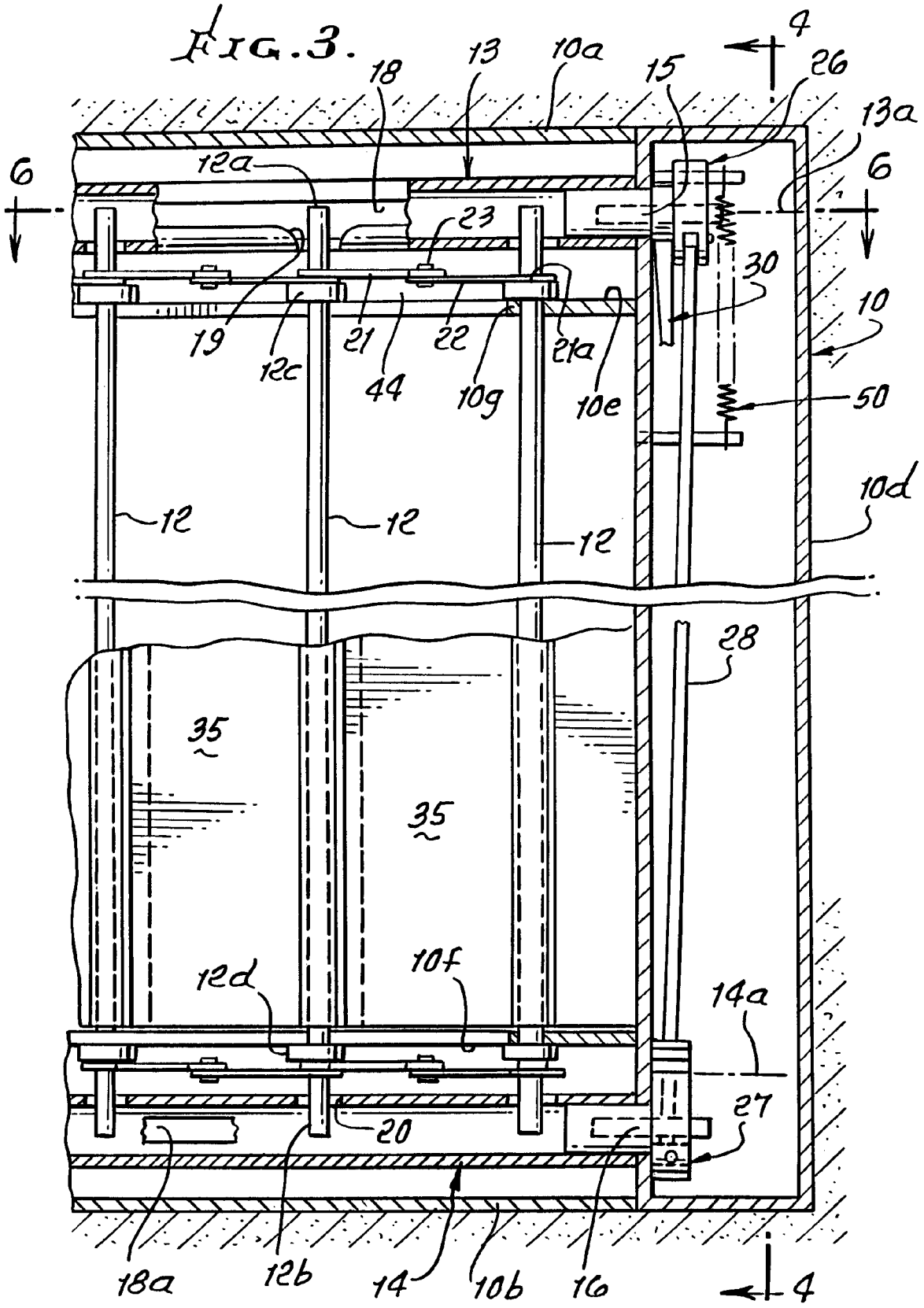
FIG. 3 is an enlarged fragmentary frontal view, showing bar extending and retracting mechanism, as well as bar locking mechanism.

A series of bars 12 is carried by the frame, for bodily movement between extended positions, as seen in FIG. 1, and retracted positions, i.e. movement away from and toward the side of the frame adjacent vertical frame section 10*d.* The bars may be metallic, and they have upper and lower ends 12*a* and 12*b,* seen in FIG. 3. The bars may have flanges 12*c* and 12*d* to slide or track along frame surfaces 10*e* and 10*f.*

Figure 8:
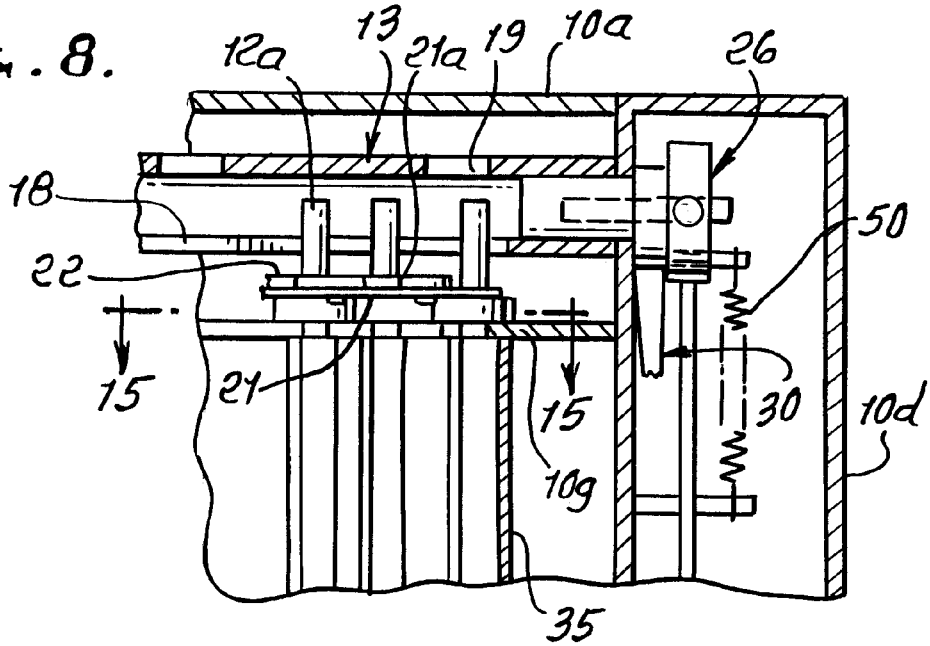
FIG. 8 is a fragmentary elevation taken on lines 8—8 of FIG. 7.

Locking members, such as upper and lower horizontally elongated rotatable keepers, are provided at 13 and 14. The ends of the keepers are suitably supported as at 15 and 16 to accommodate keeper rotation about their horizontal axes 13*a* and 14*a.* The locking members are operable to lock the opposite ends of the bars in bar extended positions, i.e. window opening protecting positions of the extended bars as seen in FIG. 3. As shown, the upper or first keeper 13 is tubular, and has a primary rotated position, as seen in FIG. 8, in which the rod upper ends extend into the tube, via an elongated main through slit 18 in the tube wall, allowing the rods to be extended and retracted, as referred to. The lower or second keeper 14 is also tubular and has a corresponding primary rotated position in which the rod lower ends extend into the tube, via an elongated main through slit 18*a,* (see FIG. 3) like slit 18, allowing the rods to be extended or retracted as referred to. Slits 18 and 18*a* extend lengthwise of the keeper tubes.

Figure 6:
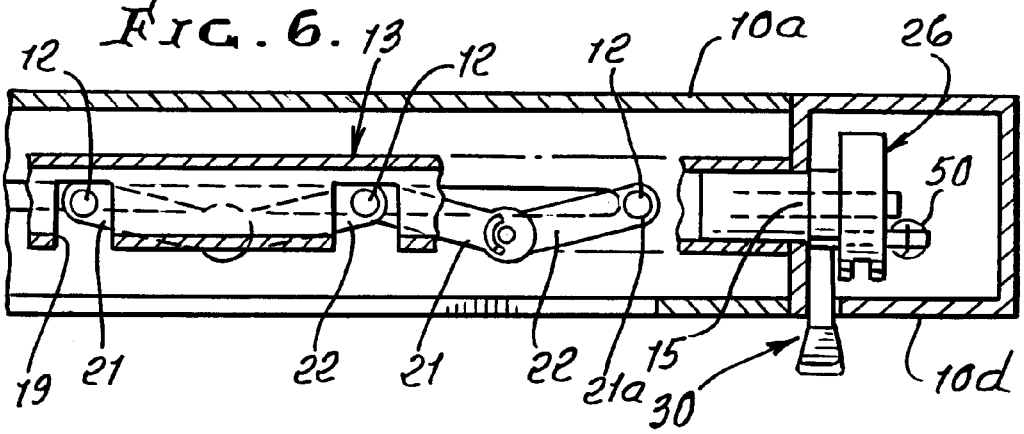
FIG. 6 is a horizontal fragmentary plan view taken in section on lines 6—6 of FIG. 3, the bars being shown in extended positions.
Figure 9:
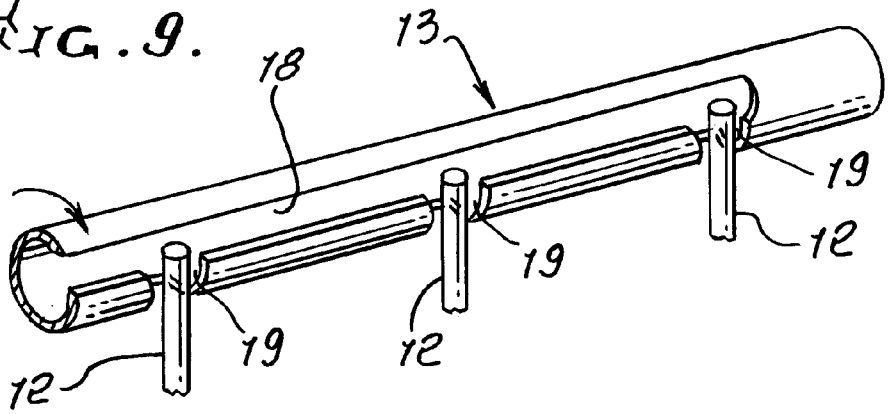
FIG. 9 is a perspective view showing a bar keeper (locking member) rotated into bar locking position.
Figure 10:
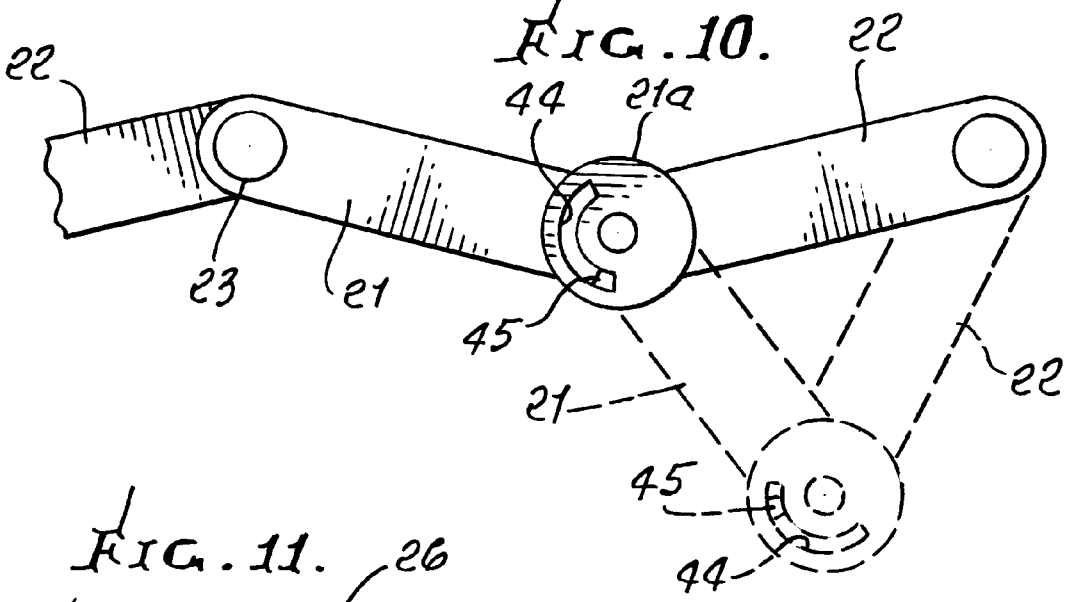
FIG. 10 is an enlarged plan view showing bar interconnecting hinge structure.
Figure 11:
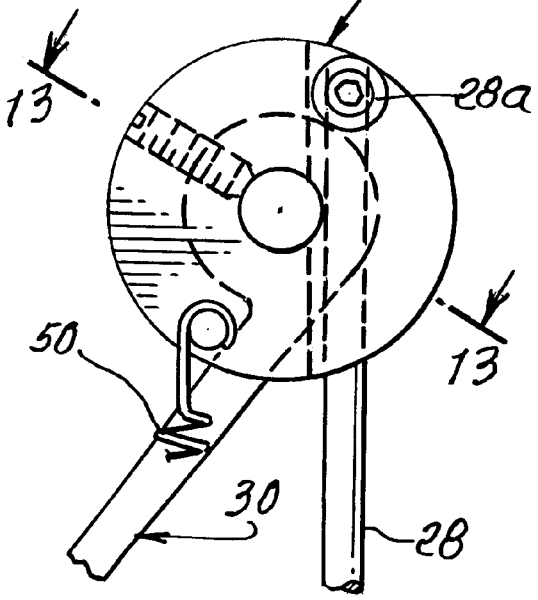
FIG. 11 is an enlarged end elevational view showing a keeper upper rotor in one position, as also seen in FIG. 5.
Figure 12:
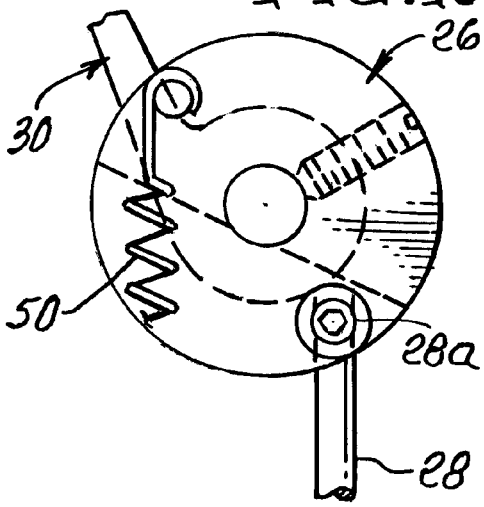
FIG. 12 is a view like FIG. 11, but showing the keeper upper rotor in an alternate position, as also seen in FIG. 4.

The upper keeper 13 also has a series of spaced apart branch through slits 19 intersecting slit 18, and extending partially circumferentially, as seen in FIGS. 3 and 9. When keeper 13 is rotated, in extended positions of the bars, the bar upper ends become captivated in and by the branch slits, blocking bar movement from extended to retracted position. This condition is also seen in FIG. 6. Likewise the lower keeper tube 14 has a series of spaced apart branch slits 20 intersecting slit 18*a,* and extending partially circumferentially. When keeper 14 is rotated (in synchronism with keeper 13), in extended positions of the bars, the bar lower ends become captivated in and by the branch slits 20 blocking bar movement from extended to retracted positions, for secure protection of window opening 11. Alternatively, when the keepers 13 and 14 are rotated back to positions in which the bar rods are aligned with the main slits 18*a* and 19*a,* the bars can then be moved to FIG. 2 retracted position, i.e. the bar ends can travel in main slits 18*a* and 19*a.*

Figure 7:
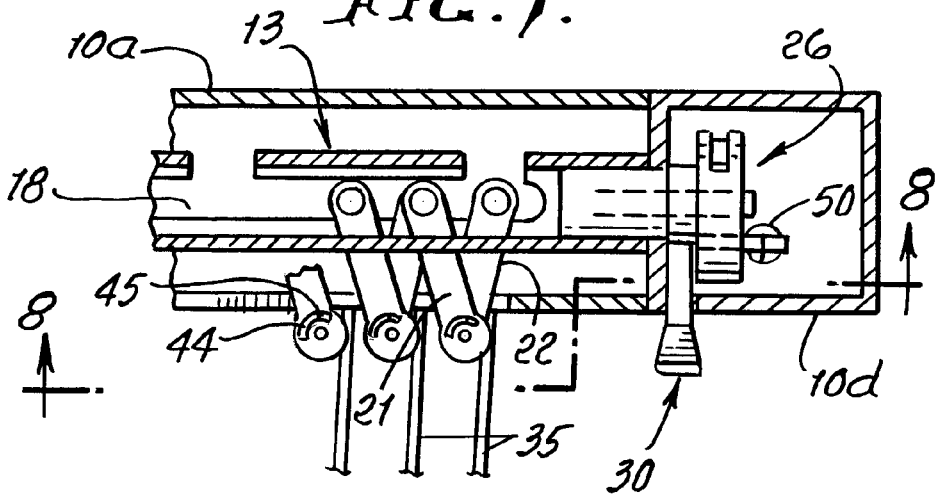
FIG. 7 is a view like FIG. 6, but showing the bars in retracted position.

Hinge links may be provided, as at 21 and 22 in FIGS. 3, 6–8, and 10, in space 44 between keeper 13 and frame wall 10*g,* to be pivotally connected with the bars near their upper ends, as at 21*a,* and the links may themselves be pivotally interconnected as at 23. Such links pivotally extend and retract, as shown in FIGS. 6 and 7, to interconnect the bars for successive movement toward extended position, and for successive movement toward retracted positions. Tongue and groove parts 45 and 46 (see FIG. 10) limit extension of the links and therefore position the bar ends to enter the branch slits.

Figure 4:
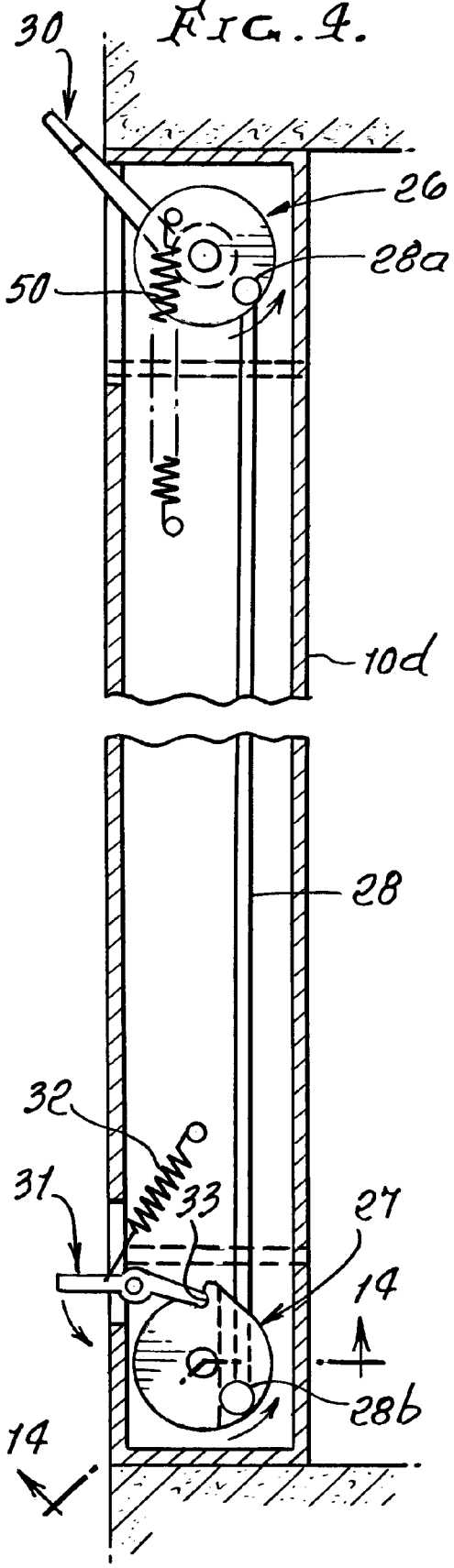
FIG. 4 is an elevation taken in section on lines 4—4 of FIG. 3, with locking mechanism in one position.
Figure 5:
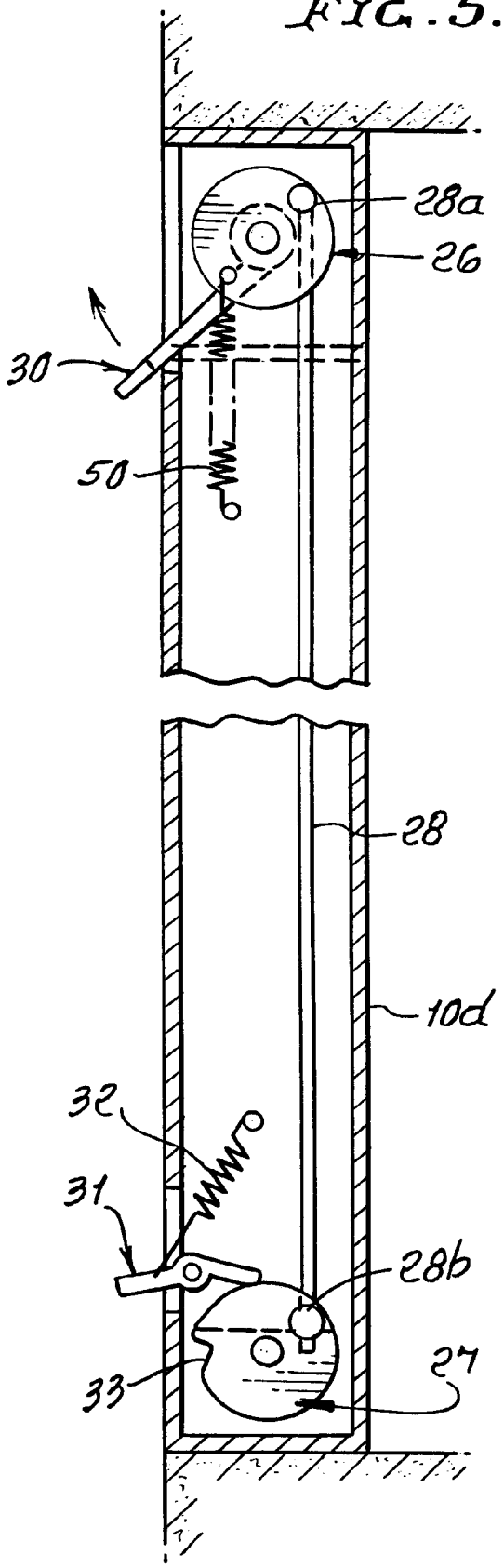
FIG. 5 is a view like FIG. 4, but showing the locking mechanism in another position.

As referred to, a mechanism or structure is provided to operatively interconnect the rotary keepers 13 and 14 to move or rotate in synchronism, so that both the upper and lower ends of the bars are locked, i.e. captivated, or unlocked, at generally the same time. Such mechanism is shown to include operatively interconnected rotors 26 and 27, rotor 26 connected to an end of upper keeper 13, and rotor 27 connected to an end of lower keeper 14. A tie rod or link 28 extends vertically between the rotors, and is pivotally connected thereto, as at 28*a* and 28*b.* A lever 30 is connected to and projects from rotor 26, to be manually moved between up-position seen in FIG. 4, and down position in FIG. 5, tension being exerted by spring 50. When so-moved, the tie rod causes simultaneous rotation (counter clockwise in FIGS. 4 and 5) of the keepers, as described. A lock lever 31 is held by a spring 32 in a pivoted position extending into a groove 33 in lower rotor 27, in FIG. 4, blocking rotation of the keepers from rod end captivating position, i.e. to secure the bars in FIG. 1 window access blocking position. When lock lever 31 is manually pivoted to released position as seen in FIG. 5, the rotors and keepers can be rotated to positions to allow retraction of the bars. Levers 30 and 31 are typically located or project at the inner (room) side of the window, for control by the occupant.

Figure 16:
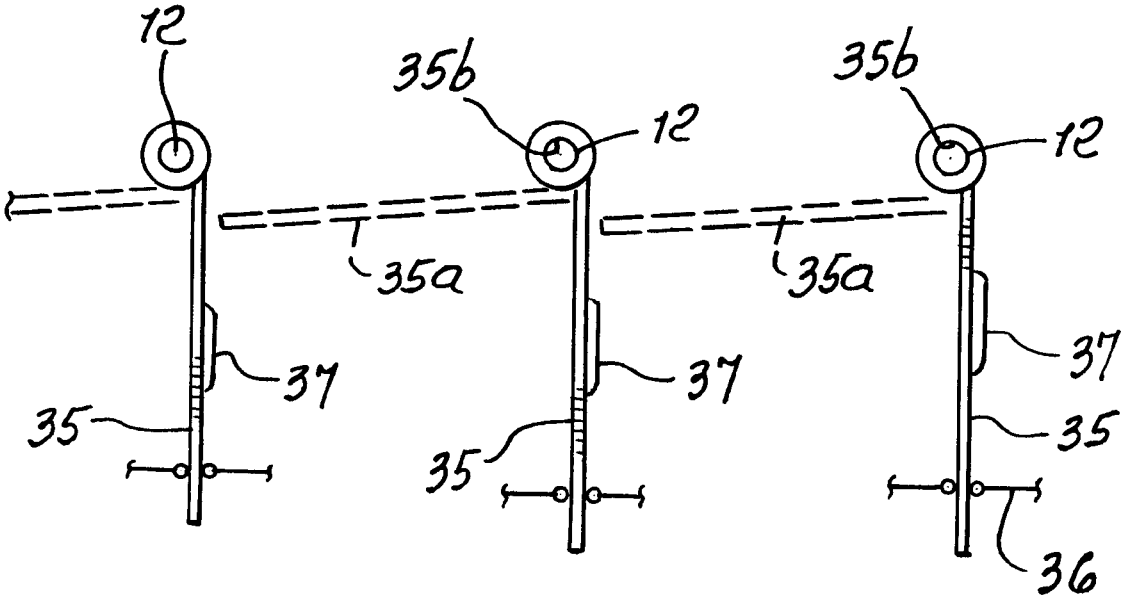
FIG. 16 shows open and closed positions of louvers.

Louvers 35 may be and are preferably pivotally connected to the rods, as seen in FIG. 15, and a flexible actuator chain 36 may be connected to the louvers, to pivot them to desired positions, relative to the window opening. Stops may be provided, as indicated at 36 in FIG. 7, to limit pivoting of the louvers, as at fully open position, as shown, and closed positions, blocking the access opening 11. See also full line, and broken line positions of the louvers 35 and 35*a,* in FIG. 16. The louvers provide decorative effect, and may be colored or have decorative designs (as at 37) on their faces. The louvers may be carried by the bars, as by bar reception in louver openings 35*b,* or by snap attachment to the bars. The louvers in closed position provide added security.

I claim:

1. In combination, a) a window frame and a series of bars carried by the frame for bodily movement toward and away from a side of the frame, said bars having ends, and b) locking members to lock opposite ends of the bars in window protecting positions thereof, and wherein the bars have been moved away from said side of the frame, c) said locking members including a first locking member movable into and out of bar end captivating position, and a second locking member movable into and out of bar end captivating position, said first and second locking members being at opposite ends of the bars, d) and structure operatively interconnecting said first and second locking members to move in synchronism.

2. The combination of claim 1 including louvers carried by the bars.

3. The combination of claim 1 including first hinged members connected with certain ends of the bars that extend in a first row and second hinged members connected with other ends of the bars that extend in a second row.

4. The combination of claim 3 wherein the frame has first and second sections that extend generally parallel, the first hinged members located proximate the frame first section, and the second hinged members located proximate the frame second section.

5. The combination of claim 1 wherein said bars comprise rods and wherein the first and second locking members comprise tubes having main slits extending lengthwise of the tubes and into which the rod ends are received for travel during said bodily movement of the rods, the tubes having branch slits into which the rod ends are alternatively received and captivated in response to tube rotation.

6. The combination of claim 1 including hinging links interconnecting successive bars, for successive movement toward extended position, and for successive movement toward retracted position.

7. The combination of claim 5 including rotors operatively connected to the tubes, and a link interconnecting the rotors to control tube rotation in synchronism.

8. The combination of claim 6 including limit structure limiting extension of the links to position the bar ends for captivation by bar locking structure.

9. The combination of claim 7 including a control part movable into and out of rotor rotation blocking position, whereby the bars are blocked against movement toward retracted position.

10. The combination of claim 2 wherein said louvers have surfaces facing toward the window exterior, and including decorative structure at said surfaces.

* * * * *